US009422036B2

(12) United States Patent
Carlson

(10) Patent No.: US 9,422,036 B2
(45) Date of Patent: Aug. 23, 2016

(54) TOWABLE STREAM GAUGE PLATFORM HAVING ASYMMETRICAL ELASTIC HARNESS

(71) Applicant: Robert Carlson, Pt. Richmond, CA (US)

(72) Inventor: Robert Carlson, Pt. Richmond, CA (US)

( * ) Notice: Subject to any disclaimer, the term of this patent is extended or adjusted under 35 U.S.C. 154(b) by 71 days.

(21) Appl. No.: 14/584,924

(22) Filed: Dec. 29, 2014

(65) Prior Publication Data

US 2015/0185245 A1 Jul. 2, 2015

Related U.S. Application Data

(60) Provisional application No. 61/922,733, filed on Dec. 31, 2013.

(51) Int. Cl.

| | |
|---|---|
| ***B63B 21/58*** | (2006.01) |
| ***B63B 35/00*** | (2006.01) |
| *B63B 21/56* | (2006.01) |
| *B63B 35/81* | (2006.01) |
| *B63B 35/73* | (2006.01) |

(52) U.S. Cl.

CPC ..... *B63B 35/00* (2013.01); *B63B 21/56* (2013.01); *B63B 35/815* (2013.01); *B63B 2035/002* (2013.01); *B63B 2035/735* (2013.01)

(58) Field of Classification Search

CPC ..... B63B 2035/813; B63B 2035/815; B63B 2035/735; B63B 21/56

USPC ..... 114/253

See application file for complete search history.

(56) References Cited

U.S. PATENT DOCUMENTS

| | | | | |
|---|---|---|---|---|
| 3,018,753 | A * | 1/1962 | Price | B63B 35/817 441/69 |
| 5,357,892 | A * | 10/1994 | Vatne | A01K 73/045 114/244 |
| 5,819,680 | A * | 10/1998 | Haller | B63B 21/56 114/253 |
| 6,306,000 | B1 * | 10/2001 | Parten | B63B 35/815 114/253 |
| 7,660,190 | B2 * | 2/2010 | Keskes | B63B 21/663 114/244 |
| 8,025,541 | B2 * | 9/2011 | Churchill | B63B 35/811 114/253 |
| 9,067,654 | B2 * | 6/2015 | Lessing | B63B 35/7933 |

* cited by examiner

*Primary Examiner* — Andrew Polay

(74) *Attorney, Agent, or Firm* — Brian Beverly; Beeson Skinner Beverly, LLP

(57) ABSTRACT

A towable stream gauge platform having an asymmetrical elastic harness comprises a buoyant flexible platform and a harness including a shock cord having first and second lengths interconnected at a loop, both lengths passing slidably through a plurality of retaining rings flexibly attached to pad eyes embedded in the top surface of the platform, a leading end of said first length extending forward of said retaining rings on one side of the platform and the loop extending forward of said retaining rings on the other side of the platform, a terminal end of the second length secured to the top surface of the platform, one end of a pull cord attached to the loop and the other end of the pull cord attached to the leading end, such that the pull cord encounters greater resistance from the loop than from the lead end when under tension.

15 Claims, 11 Drawing Sheets

TOWABLE STREAM GAUGE PLATFORM HAVING ASYMMETRICAL ELASTIC HARNESS

CROSS-REFERENCE TO RELATED APPLICATIONS

This application claims the benefit of U.S. Provisional Application No. 61/922,733 filed Dec. 31, 2013, which is incorporated herein by reference.

BACKGROUND

1. Field of the Invention

This invention relates to towable stream gauge platforms and in particular to a towable stream gauge platform having an asymmetrical elastic harness which causes a submerged hydroboard to pursue an upward twisting path toward the surface.

2. Discussion of the Prior Art

Floating towable stream gauge platforms are used to survey river courses and to gauge river and stream discharge rates using Doppler sonar measuring instruments. For purposes of brevity, and without being limiting, this disclosure will refer to towable stream gauge platforms as "hydroboards" or "boards" as they are commonly referred to in the art.

Hydroboards are modified forms of recreational boogie boards adapted to carry surveying equipment for measuring the contours or discharge rates of a body of running water. An aperture is provided centrally in the board in which a surveying instrument capable of measuring depth and velocity can be secured as with a band clamp. A hydroboard is usually towed using a flexible harness which is designed to accommodate the impact on the board of waves and currents.

A hydroboard will map the contours of a waterway by pulling it along the water's course. Alternatively, a hydroboard can be used to gauge discharge rates of a flowing body of water by retaining it from a stationary structure spanning the waterway being measured, such as a bridge. The hydroboard can be caused to traverse the waterway by crossing the spanning structure from one bank of the waterway to the other, during which the surveying equipment supported on the hydroboard measures water velocity at multiple depths. The sum of the measurements made as the equipment traverses the waterway gives a measure of the total flow.

A recurrent problem encountered when using hydroboards as described above is that the nose of the hydroboard may dip under the surface of the water in which case the hydroboard can rapidly submerge. Since the hydroboard is generally deployed at the end of a tow rope retained from in front of and above the board, the harness or tow line may snap resulting in not merely loss of the hydroboard but the expensive surveying equipment deployed on it.

Prior art hydroboards have typically been constructed using rigid polystyrene (or rigid polyethylene for boats). Thus, when the nose of a prior art hydroboard dips underwater, the board acts as an inflexible underwater sail causing the board to submerge rapidly.

DESCRIPTION OF THE ILLUSTRATED EMBODIMENT

Applicant's invention is a hydroboard having an asymmetrical elastic harness that seeks the surface when the board submerges. The asymmetrical harness causes a submerged hydroboard to pursue an upward helical path toward the surface. In addition, the hydroboard is sufficiently pliable that the board flexes into a helical shape better to follow the twisting path urged by the harness.

Figure 1:
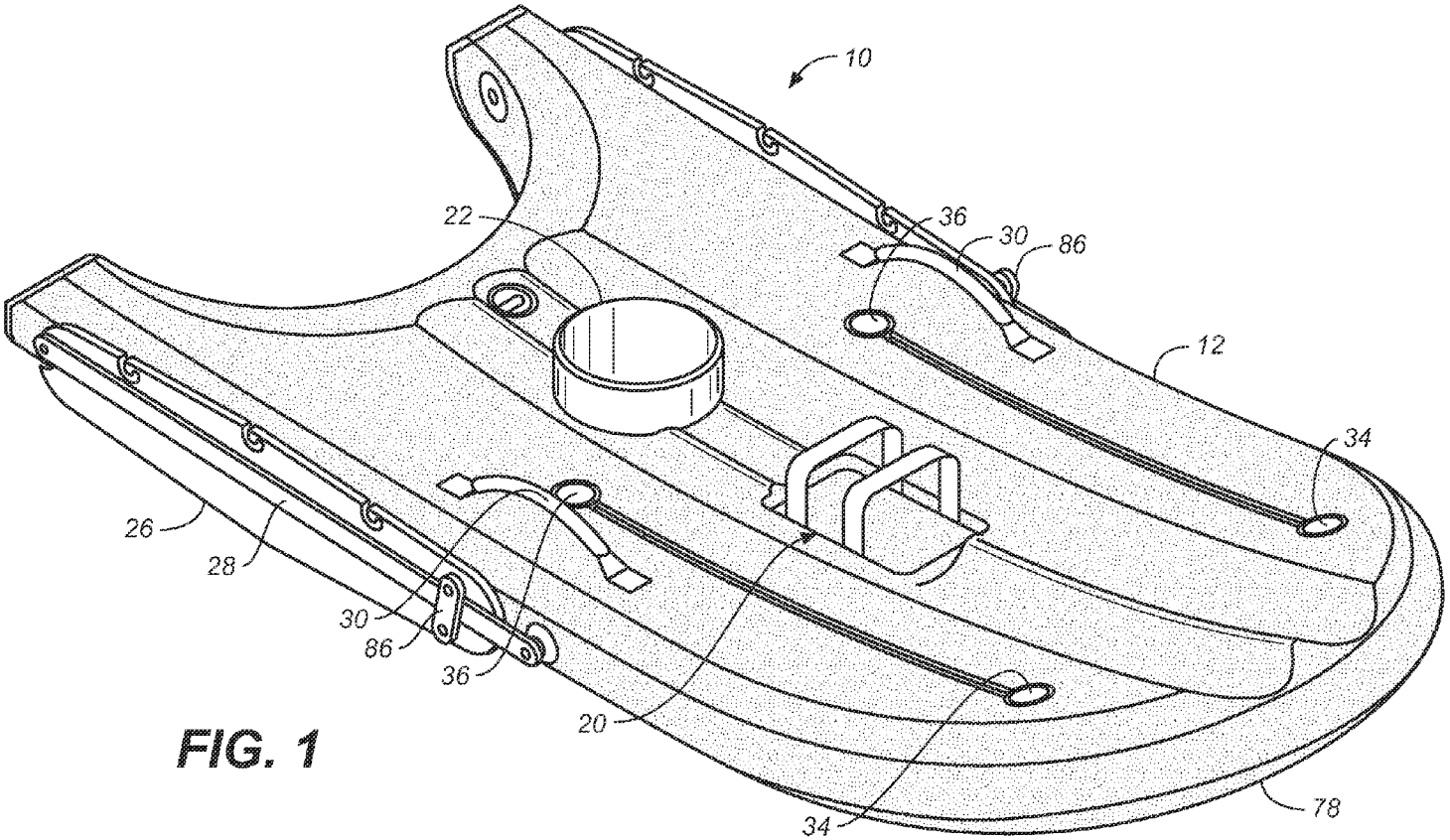
FIG. 1 is a perspective view of a hydroboard having an asymmetric elastic harness according to the invention.
Figure 2:
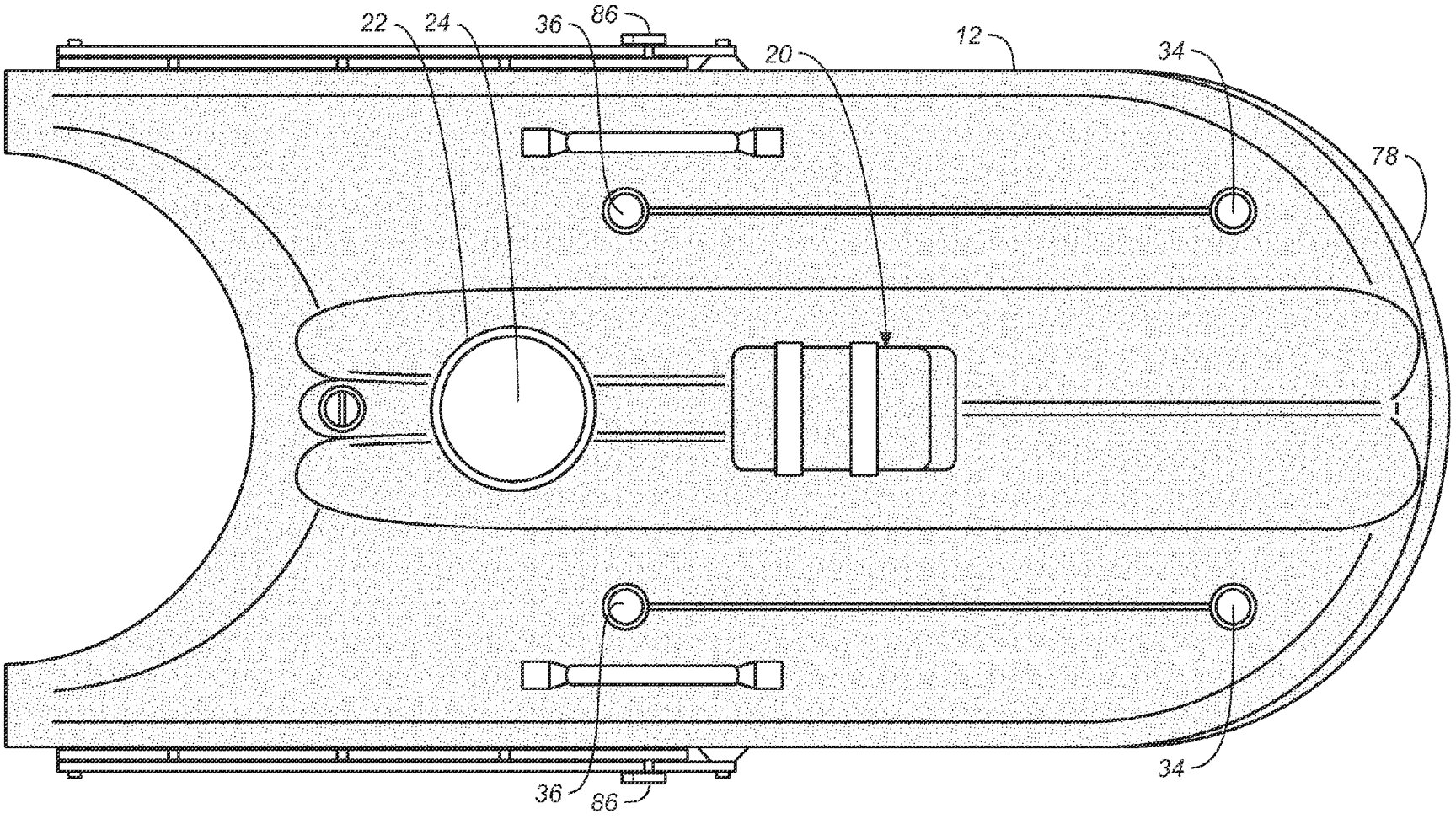
FIG. 2 is a plan view thereof.
Figure 3:
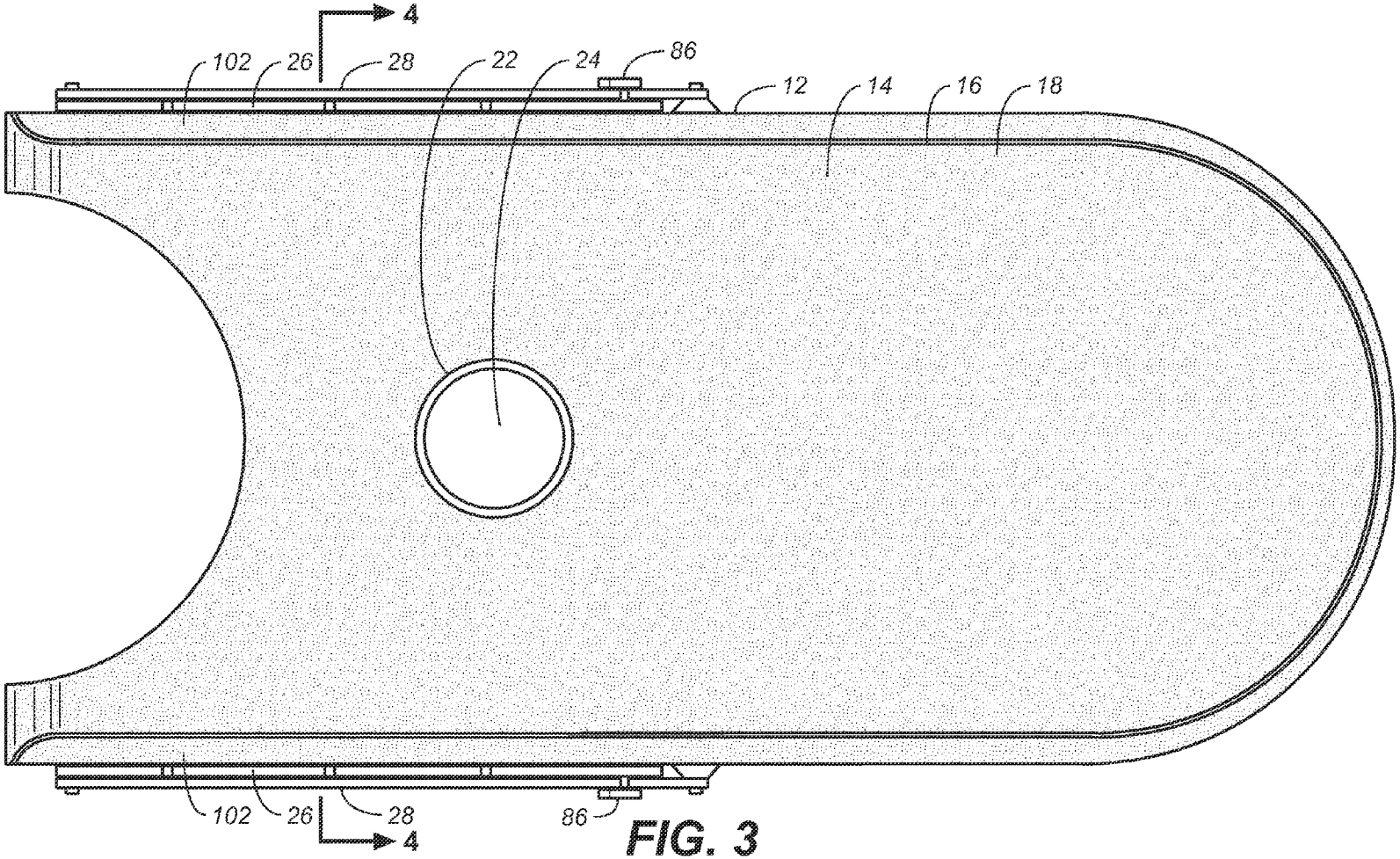
FIG. 3 is a bottom plan view thereof.
Figure 4:
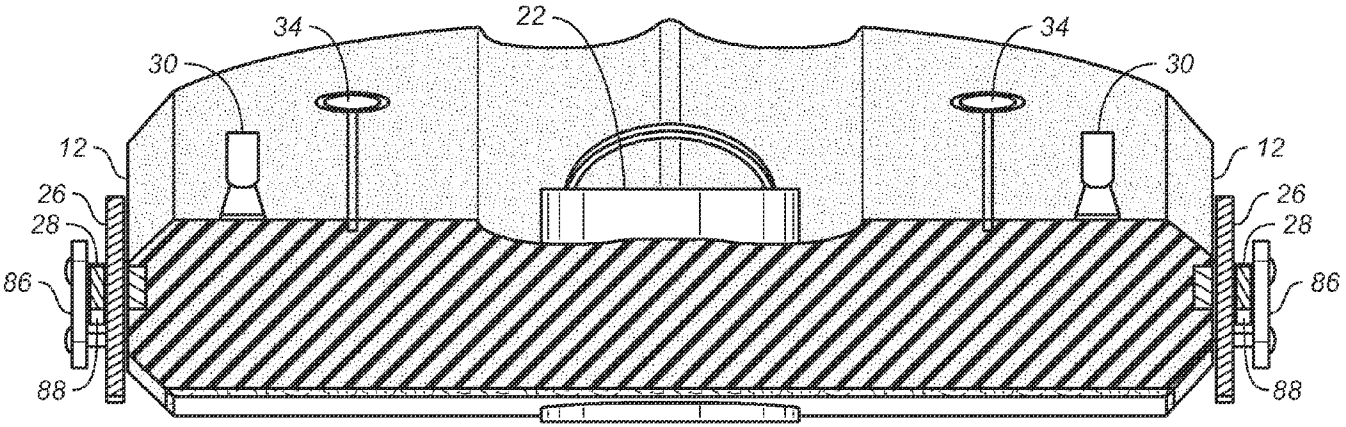
FIG. 4 is a sectional view of thereof taken along lines 4-4 of FIG. 3.

A hydroboard having an asymmetrical elastic harness according to the invention is referred to generally at numeral 10 in FIG. 1. With reference to FIGS. 1-3, the hydroboard 10 comprises a buoyant formed platform 12. As seen in FIG. 3, a skin 14 is formed on the underside of the platform 12. In one embodiment the skin 14 is formed from a closed cell backing 16 on which is mounted an HDPE coating 18 that provides a low friction protective working surface. Mount 20 is centrally located for securing a programmable control module (not shown), and a band clamp 22 is disposed in a central aperture 24 for securing surveying equipment (also not shown). Rudders 26, secured by rudder rails 28, steer the board straight. Handles 30 are provided midsection. Flexible, non-elastic long lines 32 are secured between front and rear pad eyes 34, 36 embedded in the top surface 38 of the board. It will be understood that, while long lines 32 are flexible in the nature of a cord or rope, they are not elastic in the sense that they do not stretch measurably lengthwise.

Figure 6A:
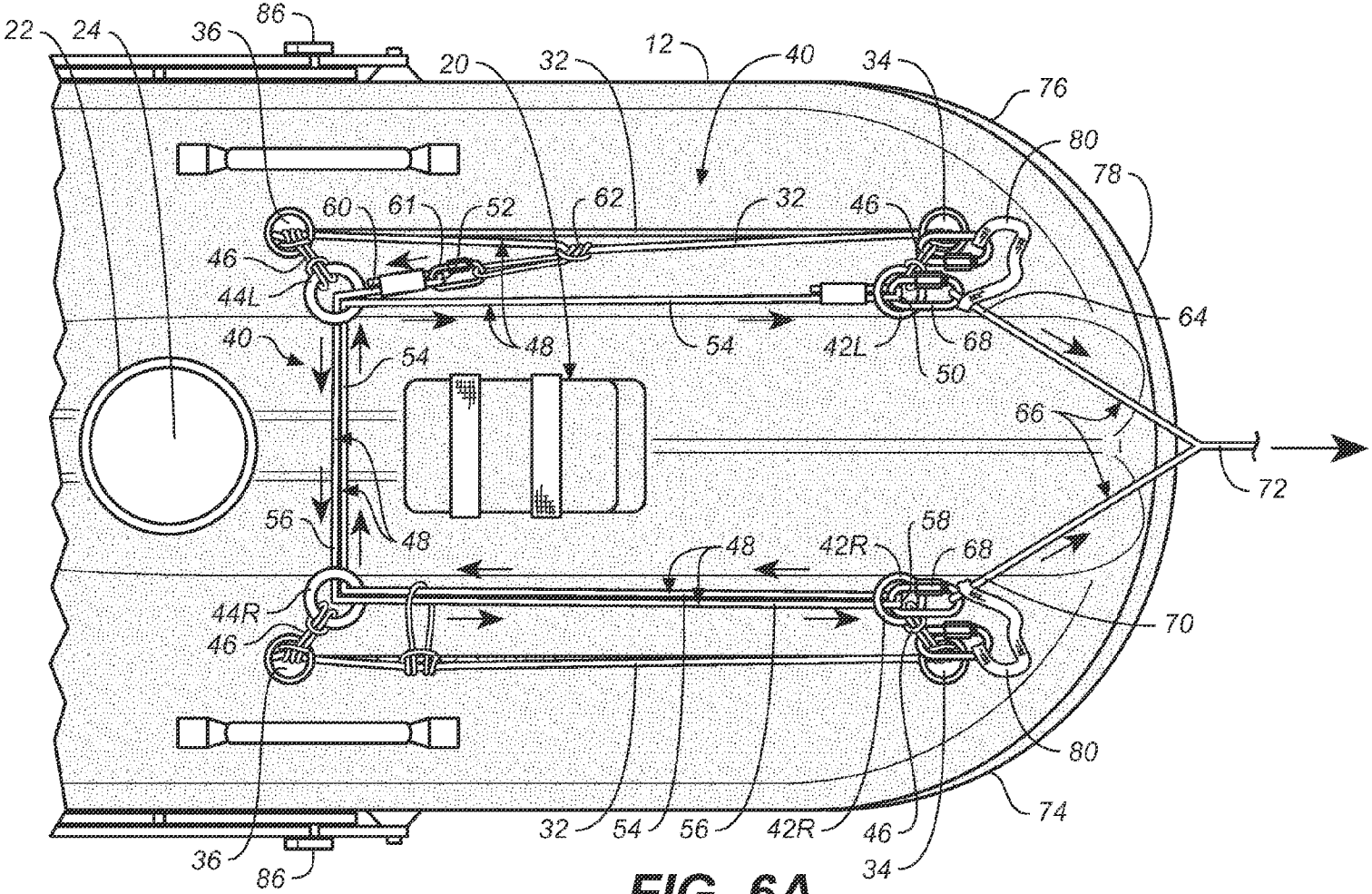
FIG. 6A is a plan view of the front portion of the hydroboard showing the asymmetrical harness with the shock cord in a retracted position.
Figure 6B:
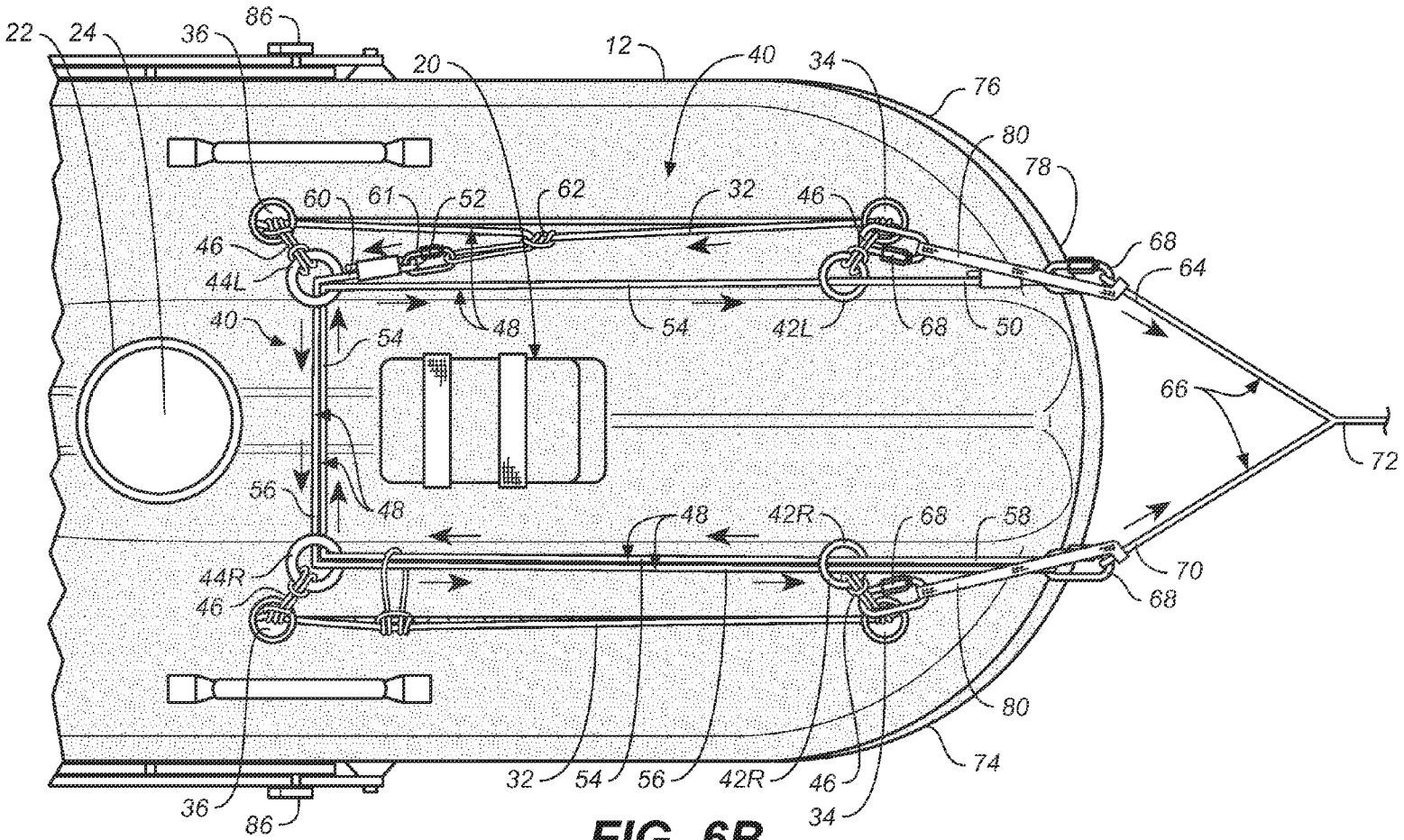
FIG. 6B is a plan view of the front portion of the hydroboard showing the shock cord of the asymmetrical harness stretched out.

An asymmetric harness 40 is now described in reference to FIGS. 6A and 6B. It is seen that front retaining rings 42L, 42R are attached to front pad eyes 34 by short flexible ties 46. Similarly, rear retaining rings 44L, 44R are attached to rear pad eyes 36 by ties 46. Like long lines 32, ties 46 are flexible, but not elastic and do not stretch lengthwise. Each of the retaining rings 42, 44 thus is freely movable about one of the pad eyes 34, 36 allowing it to rapidly shift position in response to forces imparted on it by shock cord 48 discussed below.

Shock cord 48 is a single length of elastic cord that stretches under tension. Shock cord 48 includes a lead end 50 and a fixed end 52. A first length 54 of shock cord 48 passes from lead end 50 through left front retaining ring 42L, left rear retaining ring 44L, right rear retaining ring 44R and right front retaining ring 42R thereby forming a U-shaped configuration. A second length 56 of shock cord 48, joined to the first length 54 at loop 58, passes from loop 58 through right front retaining ring 42R, right rear retaining ring 44R and left rear retaining ring 44L thereby forming an L-shaped configuration. A variable terminal length 60 of shock cord 48 extends from the left rear retaining ring 44L to the fixed end 52 by a quick link 61. The fixed end 52 is attached to an adjustable retention mechanism such as Prusik knot 62. A Prusik knot is a type of friction hitch which can be used for sliding attachment to a rope or cord. Tension applied to the Prusik knot in a direction general parallel with the rope to which the Prusik knot is attached causes the rope to twist and the knot to seize the rope. Relaxing the tension releases the knot allowing it to be slid along the rope to a selected location. In the illustrated embodiment, it is seen that the fixed end 52 of the shock cord 48 can be attached to the long line 32 at any selected location. Attachment of fixed end 52 to the long line 32 closer to one of the front pad eyes 34 stretches the shock cord 48 thereby increasing the resistance to it being further stretched. Conversely, attachment of the fixed end 50 to the long line 32 closer to one of the rear pad eyes 36 relaxes the shock cord and reduces its resistance to further stretching. Thus, the resistance of the shock cord 48 can be adjusted by moving the Prusik knot 62 to which the fixed end 52 of the shock cord 48 is attached to a selected location along the long line 32. While in the illustrated embodiment, first length 54 is shown passing from lead end 50 through the left retaining rings 42L, 44L and then through right retaining rings 42R, 44R, second length 56 passing from loop 58 first through right retaining rings 42R, 44R and then left rear retaining ring 44L, and terminal end 60 attached to a long line 32 on the left side of the platform, it will be understood that this arrangement could be reversed from left side to right side to configure the elements of the harness in the mirror image of that shown in the illustrations with equal effect. Long lines 32 are provided on each side of the platform 12 to provide that option.

In the illustrated embodiment, the lead end 50 of shock cord 48 extends forward of left front retaining ring 42L and is attached to one end 64 of a pull cord 66 with a quick link 68. The loop 58 of the shock cord 48 is attached to the other end 70 of the pull cord 66 with a second quick link 68. Quick links 68 are too large to pass through front retaining rings 42L, 42R, and therefore prevent either the loop 58 or lead end 50 of the shock cord 48 from retracting rearwardly through front retaining rings 42L, 42R.

A tow rope 72 is attached to the middle of the pull cord 66 such that pulling on the pull cord 66 with the tow rope 72 applies equal tension to the lead end 50 and to the loop 58 of the shock cord 48. The shock cord 48 thus can be made to stretch and relax in response to pulling and releasing the tow rope 72 as seen in FIGS. 6A and 6B. Application of tension to the lead end 50 and the loop 58 of the shock cord 48 causes the shock cord to extend from the lead end 50 along the entire length of the shock cord 58 to the fixed end 52 as indicated by the arrows in FIG. 6A. The resistance to tension exerted on the loop 58 is greater than the resistance encountered from exertion of tension on the lead end 50 because pulling on the loop 58 stretches both the first and second lengths 54, 56 of the shock cord whereas pulling on the lead end 50 stretches mostly the first length 54 of the shock cord 48. This asymmetric resistance to pulling the harness 40 impels the loop side 74 of the board, where the loop 58 is located, forward and upward with greater force than the lead end side 76, on which the lead end 50 is located.

Figure 10B:
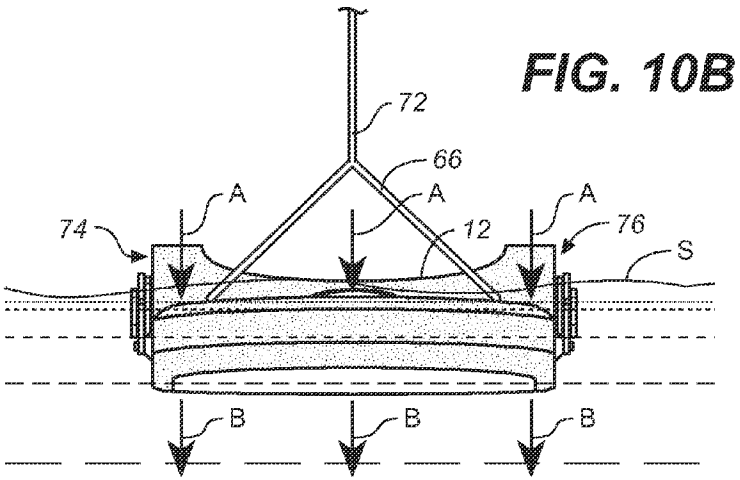
FIGS. 10A-10D are front elevation views corresponding to FIGS. 9A-9D showing the hydroboard submerged and resurfacing.
Figure 10A:
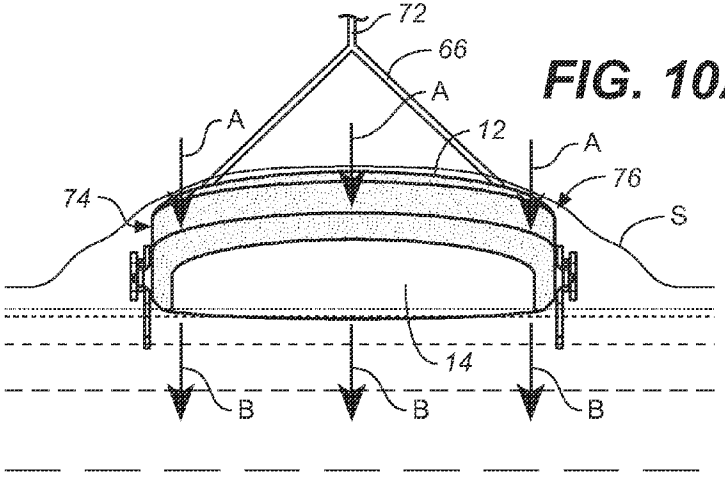
Figure 10D:
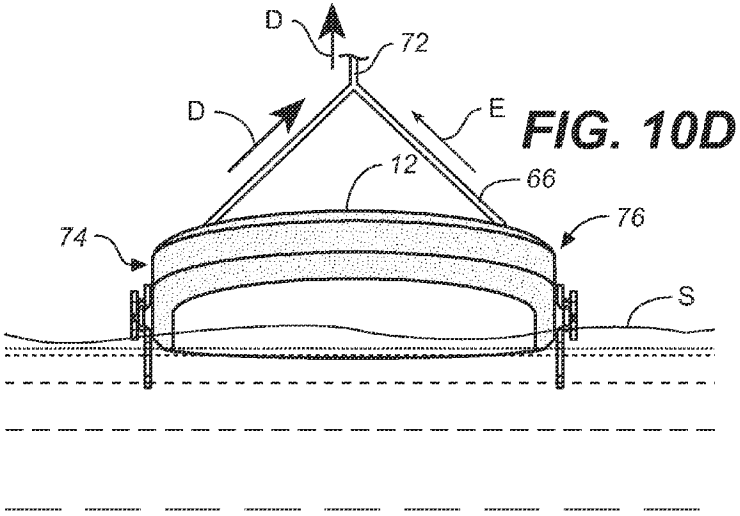
Figure 10C:
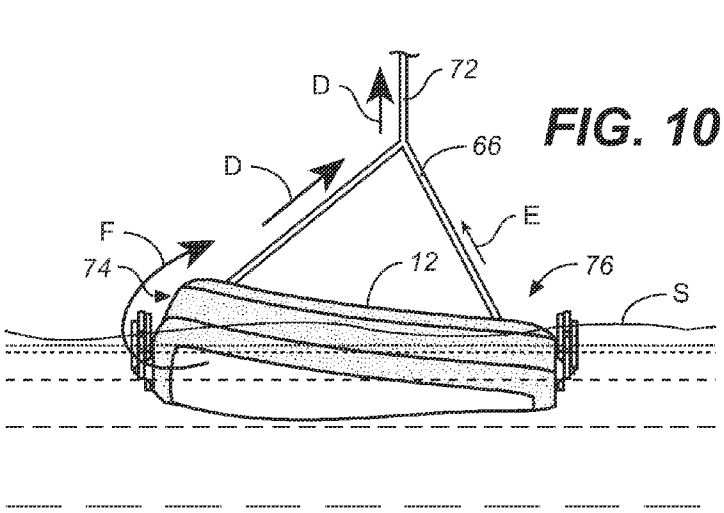

When a deployed hydroboard is riding on the surface of the water, the drag on the platform caused by the water is generally lower than the minimum tension required to pull either the loop 58 or lead end 50 forward off of the front retaining rings 42L, 42R. However, if the bow 78 of a deployed hydroboard becomes submerged as seen in FIGS. 9A, 9B, 10A and 10B, the force of the water on the bow 78, indicated by arrows A, will rapidly drive the platform further under water, as indicated by arrows B, and increase tension on the pull cord 66, indicated by arrows C. As seen in FIGS. 9C, 9D, 100 and 10D, the greater resistance on the loop side 74 of the platform 12, as indicated by arrows D, relative to the smaller resistance lead end side 76, as indicated by arrows E, increases tension on the end of the pull cord 66 on the loop side forcing that side upward and forward, as indicated by arrows F, relative to the lead end side 76, forcing the platform to the water's surface S. In one aspect of the invention, the platform 12 is constructed using flexible expanded polyethylene foam beads such that the asymmetric forces experienced when the platform becomes submerged cause it to twist into a helical shape as seen in FIG. 10C. The combined application of asymmetric pulling forces and flexure of the board causes it to pursue an upward helical path toward the surface of the water. Once tension is removed, as when the board surfaces, the shock cord 48 retracts (as seen in FIG. 6A) and tension is equalized between the two opposite sides.

Figure 7:
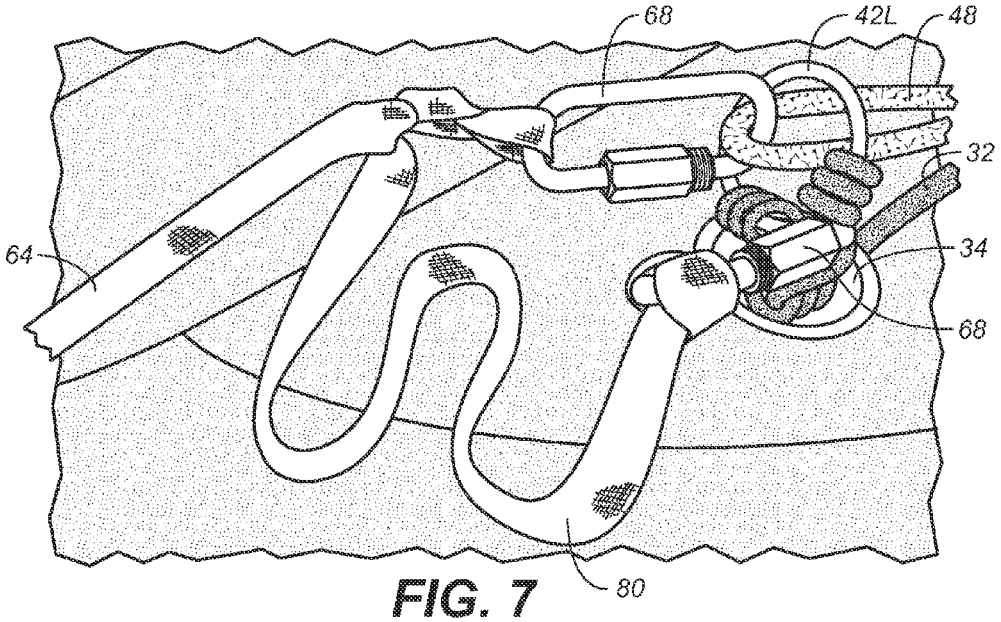
FIG. 7 is a close up perspective view showing a safety line collapsed when the shock cord is in a retracted position.
Figure 8:
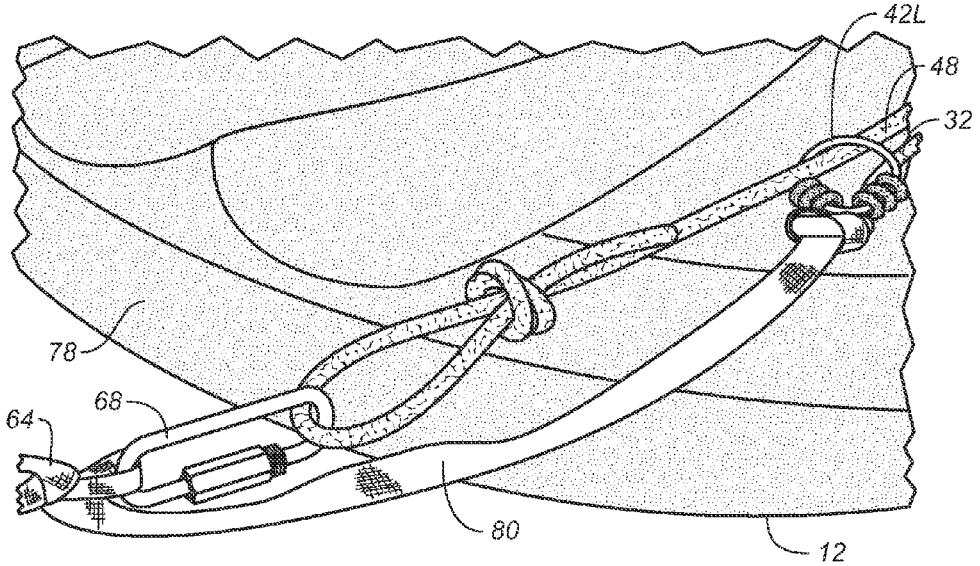
FIG. 8 is a close up perspective view showing the safety line stretched nearly to its full length when the shock cord is pulled forward under tension.
Figure 9A:
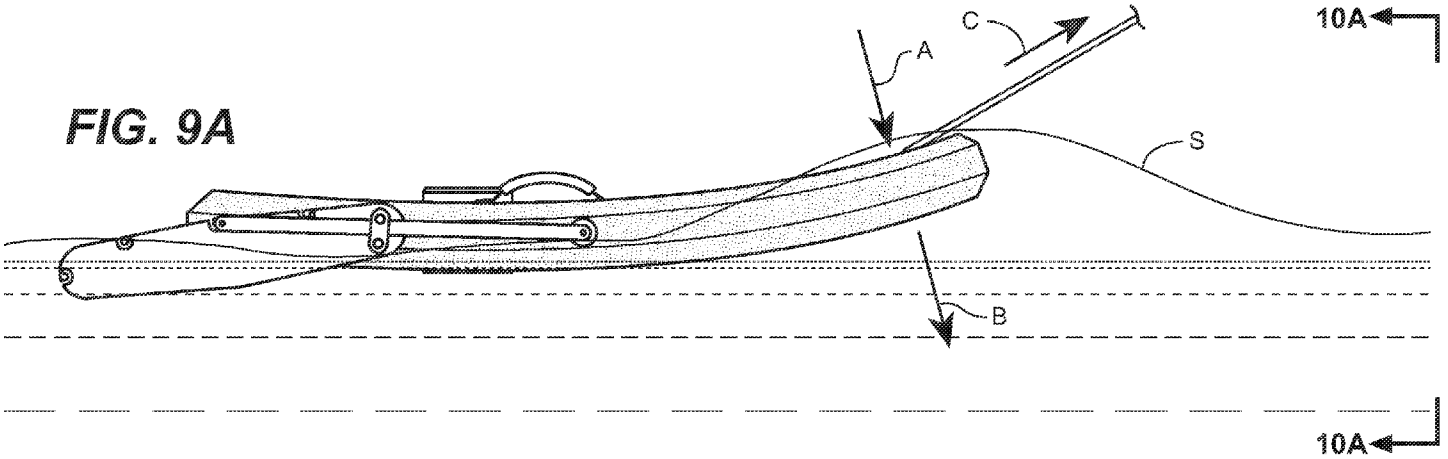
FIGS. 9A-9D are side elevation views of the hydroboard shown submerged in a body of water and resurfacing.
Figure 9B:
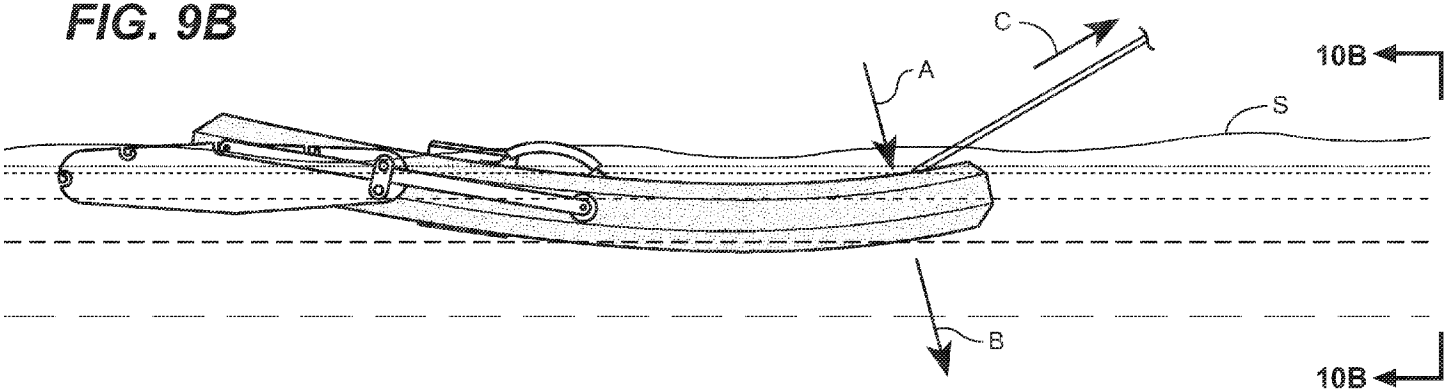
Figure 9C:
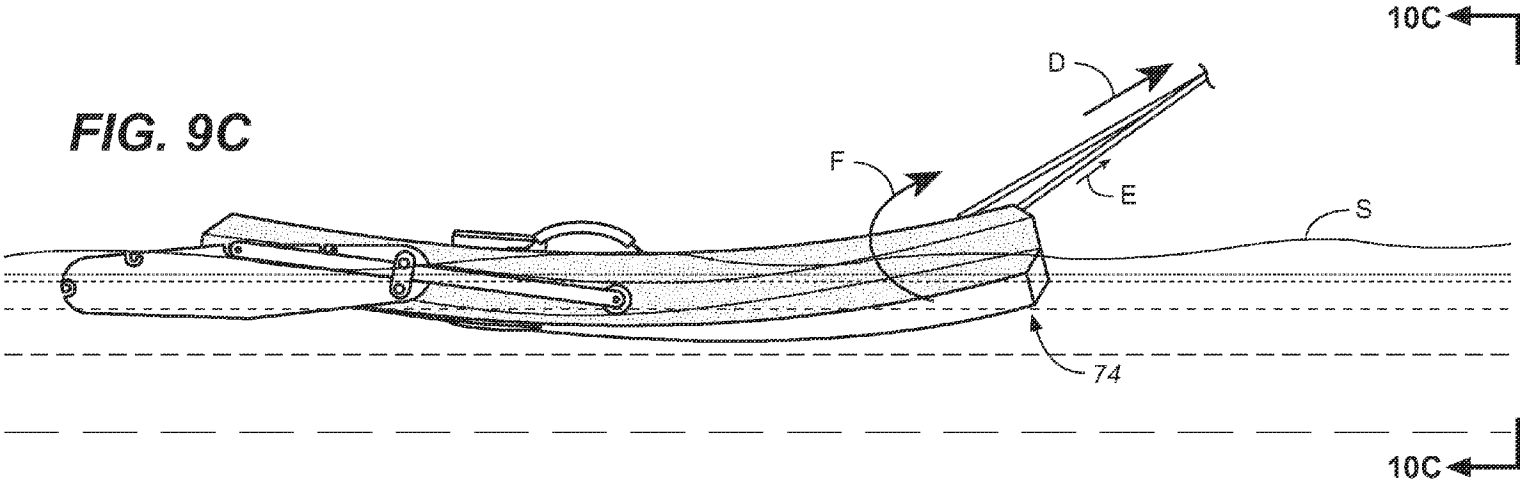
Figure 9D:
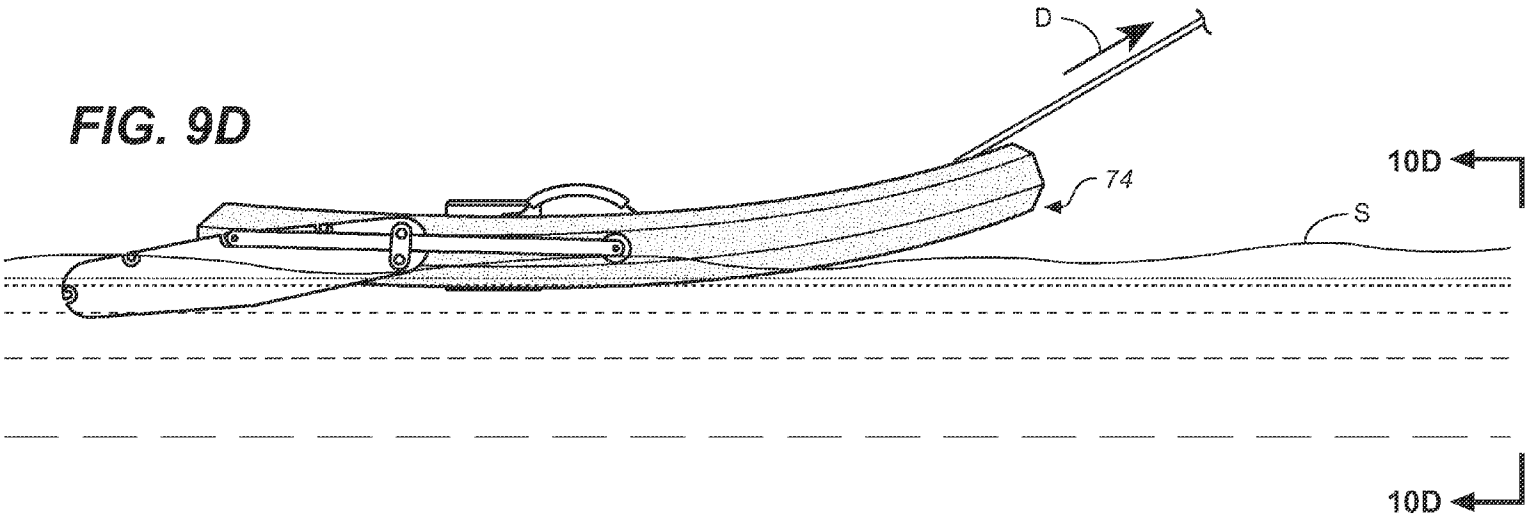

With reference now to FIGS. 6A, 6B, 7 and 8, non-elastic safety lines 80 are connected between each front pad eye 34 and the ends 64, 70 of the pull cord 66 to limit the amount that the shock cord 48 can be stretched. In FIG. 7 it is seen that the shock cord 48 is retracted and the safety line 80 is gathered loosely between the pad eye 34 and the quick link 68 interconnecting the lead end of shock cord 48 and pull cord 66. In FIG. 8, it is seen that when fully extended the safety line 80 will prevent excessive stretching of the shock cord 48. In the embodiment shown in FIG. 7, safety line 80 is connected to pad eye 34 by a quick link 68. It should be understood that safety line 80 may be connected directly to pad eye 34, long line 32, retaining link 42L or other gear in the immediate vicinity of pad eye 34, such as tie 46 as shown in FIGS. 6A and 6B.

Figure 5A:
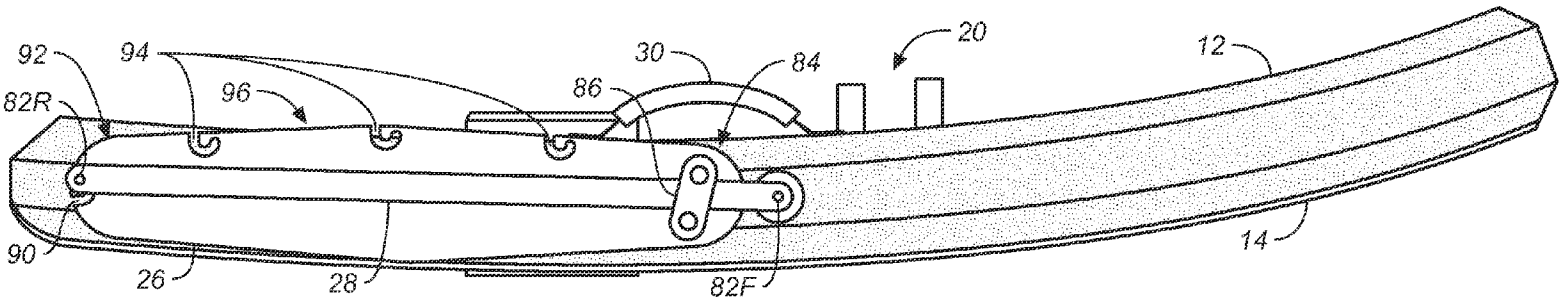
FIG. 5A is a side elevation view thereof.
Figure 5B:
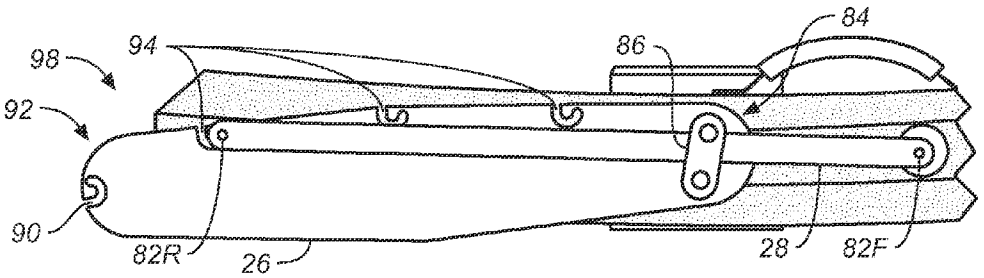
FIGS. 5B-5D are side elevation views thereof showing the rudder in different deployment configurations.
Figure 5C:
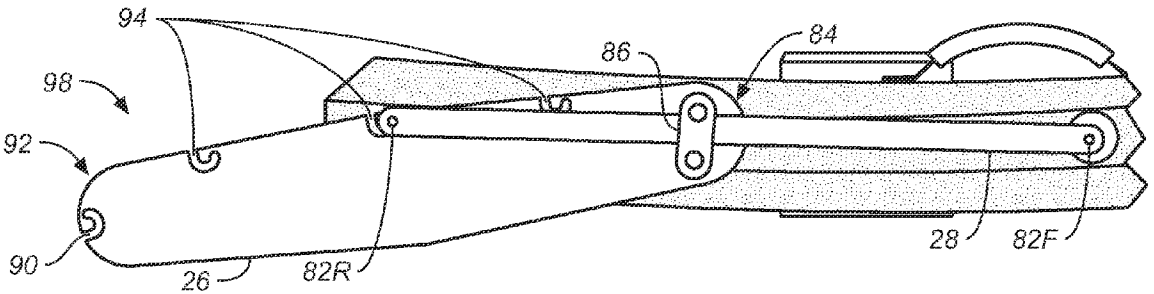
Figure 5D:
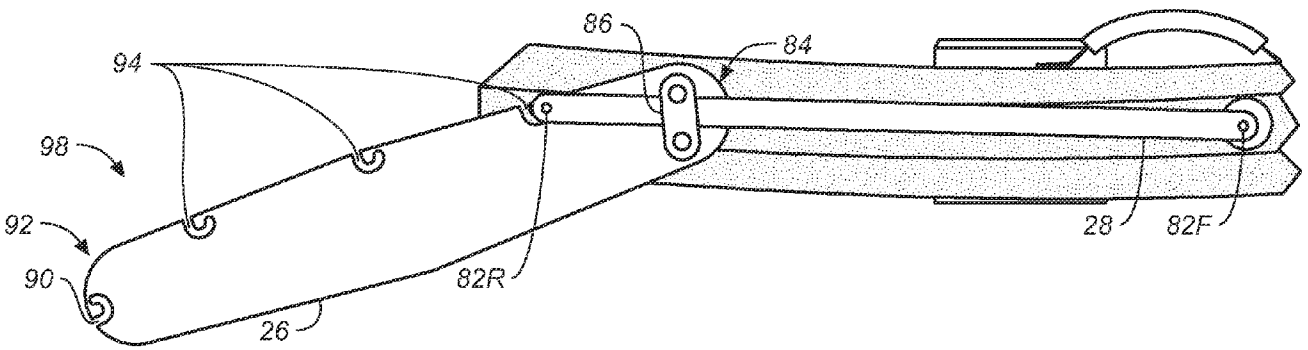

With reference to FIGS. 4 and 5A-5D, rudders 26 are provided on each side of the platform 12. A rudder rail 28 is spaced laterally from and attached to the stern end of each side of the platform by forward and rear fasteners 82F, 82R. Each of the rudders 26 is slidably captured between one of the rudder rails 28 and the side of the platform. The forward end 84 of each rudder 26 is slidably affixed to the rudder rail 28 with a vertically-disposed retaining bar 86. The rudder rail 28 is slidably captured in the control slot 88 formed between the transversely extending retaining bar 86 and the rudder 26. An arced locking notch 90 is formed in the back end 92 of the rudder and similar forward sweeping arced position selection notches 94 are formed in the top side of each rudder 26. The rudder 26 is thus movable between a stowed configuration 96 as shown in FIG. 5A and deployed configurations 98 as shown in FIGS. 5B-5D. In the stowed configuration 96, the forward end 84 of the rudder 26 is slid to a forward position along the rudder rail 28 and the rear rudder fastener 82R is captured in locking notch 90. The rudders 26 can be moved to selected deployed configurations 98 by moving the forward end 84 of the rudder 26 rearward along the rudder rail 28, and maneuvering the rear rudder fastener 82R into a selected one of the position selection notches 94 as seen. It can be seen that retaining bar 86 is mounted on rudder 26 at a slight angle from perpendicular to the longitudinal axis of the rudder in order to prevent the rudder from rotating to too great an angle relative to the platform 12 upon deployment. Rearward forces caused by flowing water impacting the rudders 26 will tend to push the back ends 92 of the deployed rudders backward and upward thereby urging the position selection notches 94 to remain around the ferrule 100 and securing the rudders in the selected position. It can be seen that each rudder has an overall planar geometry, and since the sides of the platform present flat surfaces 102 parallel with the longitudinal dimension of the board, any movement of the rudders 26 between the sides of the board and the rudder rails 28 will maintain the rudders 26 in parallel alignment with the sides of the platform 12 and help steer the hydroboard on a straight course.

An improved hydroboard having an asymmetrical elastic harness has the unique advantage over prior art hydroboards that it will tend to seek the surface upon becoming submerged in a moving body of water, thus reducing risk of loss of the hydroboard and the surveying equipment installed on the hydroboard.

There have thus been described and illustrated certain embodiments of a towable stream gauge platform having an asymmetrical elastic harness according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

I claim:

1. A towable stream gauge platform having asymmetrical elastic harness comprises:

a buoyant platform having a bow, a top surface, and left and right sides, and a harness including a plurality of retaining rings including a front retaining ring and a rear retaining ring disposed on each of said left and right sides, the front retaining ring on each side secured to the top surface of said platform near said bow, the rear retaining ring on each side secured to the top surface of said platform rearward of the front retaining ring, an elastic shock cord having a leading end and a fixed end, said shock cord bent back on itself at a loop to form first and second lengths, said first length slidably extending from said leading end through the front and rear retaining rings of one of said left and right sides and the rear and front retaining rings of the other of said left and right sides, said second length slidably extending from said loop through the front and rear retaining rings of one of said left and right sides and the rear retaining ring of the other of said left and right sides, said leading end extending forward of one of said front retaining rings and said loop extending forward of the other of said front retaining rings, said fixed end attached to said platform, and a pull cord having two opposite ends and a midpoint, one of the ends of said pull cord attached to said leading end and the other of said ends slidably attached at said loop to said shock cord, wherein, application of forward and upward force at the midpoint of said pull cord imparts substantially equal forward and upward tension to the leading end and to the loop of said shock cord, said shock cord extending and retracting in response to variations in said tension, and in response to said tension greater resistance is encountered from said loop than from said leading end and the side of the platform on which the loop is disposed moves forward and upward with greater force relative to the other side of the platform.

2. The platform of claim 1 wherein:

said platform is flexible and the top surface thereof has a front portion, during application of a uniform force bearing on at least said front portion and simultaneous application of forward and upward tension on the leading end and the loop of said shock cord, the bow of said platform flexes upwardly on the side on which said loop is located relative to the other side of said platform, thereby forming said platform into a helical shape.

3. The platform of claim 1 further comprising:

a plurality of anchor points disposed in said top surface, said plurality of anchor points including two front and two rear anchor points, said front anchor points disposed near the bow of said platform, said rear anchor points disposed rearward of said front anchor points, and a plurality of flexible ties, said ties connecting each of said retaining rings to one of said anchor points, such that each of said retaining rings is movable on the top surface of said platform about one of said anchor points responsive to forces imparted by said shock cord.

4. The platform of claim 3 wherein:

said plurality of anchor points comprises a plurality of recessed pad eyes embedded in the top surface of said platform.

5. The platform of claim 3 wherein:

a long line having a front end secured to one of said front anchor points and a rear end secured to one of said rear anchor points, the fixed end of said shock cord slidably attached to said long line, said shock cord having a terminal length disposed substantially parallel with and adjacent to said long line and extending between said fixed end and one of said rear retaining rings, wherein application of tension on said terminal length in a direction parallel to said long line longitudinally locks the fixed end of said shock cord on said long line.

6. The platform of claim 5 wherein:

the resilience of said shock cord is adjustable by attaching said fixed end to a selected location along said long line.

7. The platform of claim 6 further comprising:

an adjustable retention mechanism slidingly attached to said long line between said front and rear ends thereof, wherein the fixed end of said shock cord is attached to said retention mechanism.

8. The platform of claim 7 wherein:

said adjustable retention mechanism comprises a Prusik knot.

9. The platform of claim 1 further comprising:

a long line having a front end secured to the top surface of said platform and a rear end secured to the top surface of said platform rearward of said front end, said fixed end of said shock cord slidably attached to said long line, said shock cord having a terminal length disposed substantially parallel with and adjacent to said long line and extending between said fixed end and one of said rear retaining rings, wherein application of tension on said terminal length in a direction parallel to said long line longitudinally locks the fixed end of said shock compromise on said long line.

10. The platform of claim 9 further comprising:

an adjustable retention mechanism slidingly attached to said long line between said front and rear ends thereof, wherein the fixed end of said shock cord is attached to said retention mechanism.

11. The platform of claim 10 wherein:

said long line is not elastic.

12. The platform of claim 1 wherein:

the first length of said shock cord forms a U-shaped configuration.

13. The platform of claim 12 further comprising:

the second length of said shock cord forms an L-shaped configuration.

14. The platform of claim 1 further comprising:

substantially non-elastic safety lines, each of said safety lines secured to said platform and to one end of said pull cord for limiting the tension placed on said shock cord by forces applied to said pull cord.

15. A towable stream gauge platform having asymmetrical elastic harness comprises:

a buoyant platform having a bow, a top surface, and left and right sides, a plurality of anchor points disposed in said top surface, said plurality of anchor points including two front and two rear anchor points, said front anchor points disposed near the bow of said platform, said rear anchor points disposed rearward of said front anchor points, one of said front anchor points and one of said rear anchor points disposed on each of the left and right sides of said platform, a plurality of flexible ties, a plurality of retaining rings including a front retaining ring and a rear retaining ring disposed on each of said left and right sides, the front retaining ring on each side secured to one of said front anchor points by one of said plurality of ties, the rear retaining ring on each side secured to one of said rear anchor points by one of said plurality of ties, such that each of said retaining rings is movable about one of said anchor points responsive to forces impacting said retaining rings, a substantially non-elastic long line having a front end secured to one of said front anchor points and a rear end secured to one of said rear anchor points, a resilient shock cord having a leading end and a fixed end, said shock cord bent back on itself at a loop to form first and second lengths, said first length slidably extending from said leading end through the front and rear retaining rings of one of said left and right sides and the rear and front retaining rings of the other of said left and right sides, said second length slidably extending from said loop through the front and rear retaining rings of one of said left and right sides and the rear retaining ring of the other of said left and right sides, said leading end extending forward of one of said front retaining rings and said loop extending forward of the other of said front retaining rings, an adjustable retention mechanism slidingly attached to said long line between said front and rear ends thereof, said fixed end of said shock cord attached to said retention mechanism, said shock cord having a terminal length disposed substantially parallel with and adjacent to said long line and extending between said fixed end and one of said rear retaining rings, application of tension on said terminal length in a direction parallel to said long line locking the retention mechanism cord longitudinally on said long line, and a pull cord having two opposite ends and a midpoint, one of the ends of said pull cord attached to said leading end and the other of said ends slidably attached at said loop to said shock cord, wherein, upon application of forward and upward force at the midpoint of said pull cord, substantially equal forward and upward tension is imparted to the leading end and to the loop of said shock cord, said shock cord extends and retracts in response to variations in said tension, and greater resistance to said tension is encountered from said loop than from said leading end such that the side of the platform on which the loop is disposed tends to move forward and upward relative to the other side of the platform.

* * * * *